US008147269B2

(12) United States Patent
Yamaji et al.

(10) Patent No.: US 8,147,269 B2
(45) Date of Patent: Apr. 3, 2012

(54) CONNECTOR ASSEMBLY

(75) Inventors: Takahiro Yamaji, Tokyo (JP); Kazushi Kamata, Hirosaki (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 146 days.

(21) Appl. No.: 12/657,480

(22) Filed: Jan. 21, 2010

(65) Prior Publication Data

US 2010/0184337 A1 Jul. 22, 2010

(30) Foreign Application Priority Data

Jan. 22, 2009 (JP) ..... 2009-012408

(51) Int. Cl.
*H01R 13/62* (2006.01)

(52) U.S. Cl. ..... 439/372

(58) Field of Classification Search ..... 439/372, 439/350, 352, 358, 676, 92, 95, 157–160
See application file for complete search history.

(56) References Cited

U.S. PATENT DOCUMENTS

| | | | | |
|---|---|---|---|---|
| 6,948,958 | B1 | 9/2005 | Kikuchi et al. | |
| 7,578,689 | B2 * | 8/2009 | Guan et al. | 439/327 |
| 7,927,122 | B2 * | 4/2011 | Yamaji et al. | 439/342 |
| 8,075,324 | B2 * | 12/2011 | Yamaji et al. | 439/188 |
| 2004/0235324 | A1 | 11/2004 | Kimura et al. | |
| 2009/0186514 | A1 * | 7/2009 | Kato | 439/372 |

FOREIGN PATENT DOCUMENTS

| | | |
|---|---|---|
| CN | 1540805 | 10/2004 |
| JP | 2002-100444 | 4/2002 |
| JP | 2004-327168 | 11/2004 |
| JP | 2005-267977 | 9/2005 |
| JP | 2008-112700 | 5/2008 |

OTHER PUBLICATIONS

Chinese Office Action dated Oct. 10, 2011 with English translation of same.

* cited by examiner

*Primary Examiner* — Tulsidas C Patel
*Assistant Examiner* — Phuongchi Nguyen
(74) *Attorney, Agent, or Firm* — Collard & Roe, P.C.

(57) ABSTRACT

A connector assembly has a receptacle connector mounted on a substrate and a plug connector matable with and removable from the receptacle connector on a plane parallel to the substrate. The plug connector includes side portions. The receptacle connector includes guiding portions configured to guide the side portions of the plug connector for mating and removal of the plug connector and fixing portions fixed on the substrate and formed integrally with the corresponding guiding portions.

7 Claims, 5 Drawing Sheets

CONNECTOR ASSEMBLY

CROSS REFERENCE TO RELATED APPLICATIONS

Applicants claim priority under 35 U.S.C. §119 of Japanese Patent Application No. JP2009-012408 filed on Jan. 22, 2009.

BACKGROUND OF THE INVENTION

The present invention relates to a connector assembly including a plug connector and a receptacle connector, and more particularly to a connector assembly including a receptacle connector mounted on a substrate and a plug connector matable and unmatable with the receptacle connector on a plane parallel to the substrate.

This type of connector assembly is disclosed in FIGS. 8 to 11 of JP-A 2005-267977 (Prior Art 1), the contents of which are incorporated herein by reference. A plug connector of the connector assembly of Prior Art 1 has an operation member attached to rear ends on opposite sides of the plug connector in a longitudinal direction. When the operation member is pulled rearward, a locking state of lock portions of the plug connector is released.

FIGS. 1 to 5 of JP-A 2005-267977 disclose a connector assembly having a lock mechanism using a metal operation member (pull bar) (Prior Art 2). Furthermore, another connector assembly having a similar lock mechanism is also disclosed in JP-A 2008-112700 (Prior Art 3). In those connector assemblies having a lock mechanism using a metal operation member as in Prior Art 2 and Prior Art 3, a plug connector is mated with and removed from a receptacle connector in a direction perpendicular to a substrate.

In the connector assembly of Prior Art 1, the mating state of the plug connector with the receptacle connector may be unlocked when cables held in the plug connector are urged.

SUMMARY OF THE INVENTION

It is, therefore, an object of the present invention to provide a connector assembly that is so strong against urging of cables or the like that a mating state of connectors is maintained.

One aspect of the present invention provides a connector assembly having a receptacle connector mounted on a substrate and a plug connector matable with and removable from the receptacle connector on a plane parallel to the substrate. The plug connector includes side portions. The receptacle connector includes guiding portions configured to guide the side portions of the plug connector for mating and removal of the plug connector and fixing portions fixed on the substrate and formed integrally with the corresponding guiding portions.

Another aspect of the present invention provides a plug connector used in the aforementioned connector assembly.

Another aspect of the present invention provides a receptacle connector used in the aforementioned connector assembly.

An appreciation of the objectives of the present invention and a more complete understanding of its structure may be had by studying the following description of the preferred embodiment and by referring to the accompanying drawings.

Figure 1:
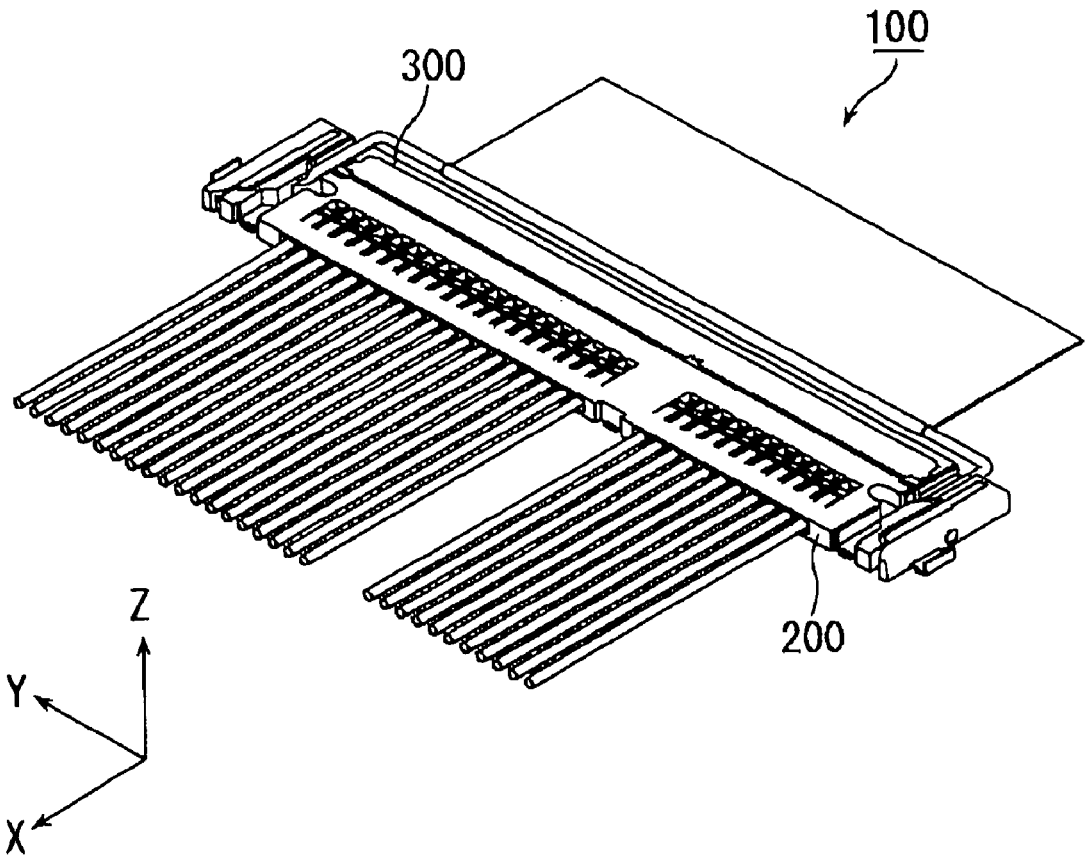
FIG. 1 is a perspective view showing a connector assembly including a plug connector and a receptacle connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector assembly 100 according to an embodiment of the present invention includes a plug connector 200 and a receptacle connector 300 to which the plug connector 200 is connected. The receptacle connector 300 is mounted on a substrate (not shown). The plug connector 200 is matable with and removable from the receptacle connector 300 on a plane parallel to the substrate (XY-plane). More specifically, the illustrated plug connector 200 is matable with and removable from the receptacle connector 300 along the X-direction (first direction).

Figure 2:
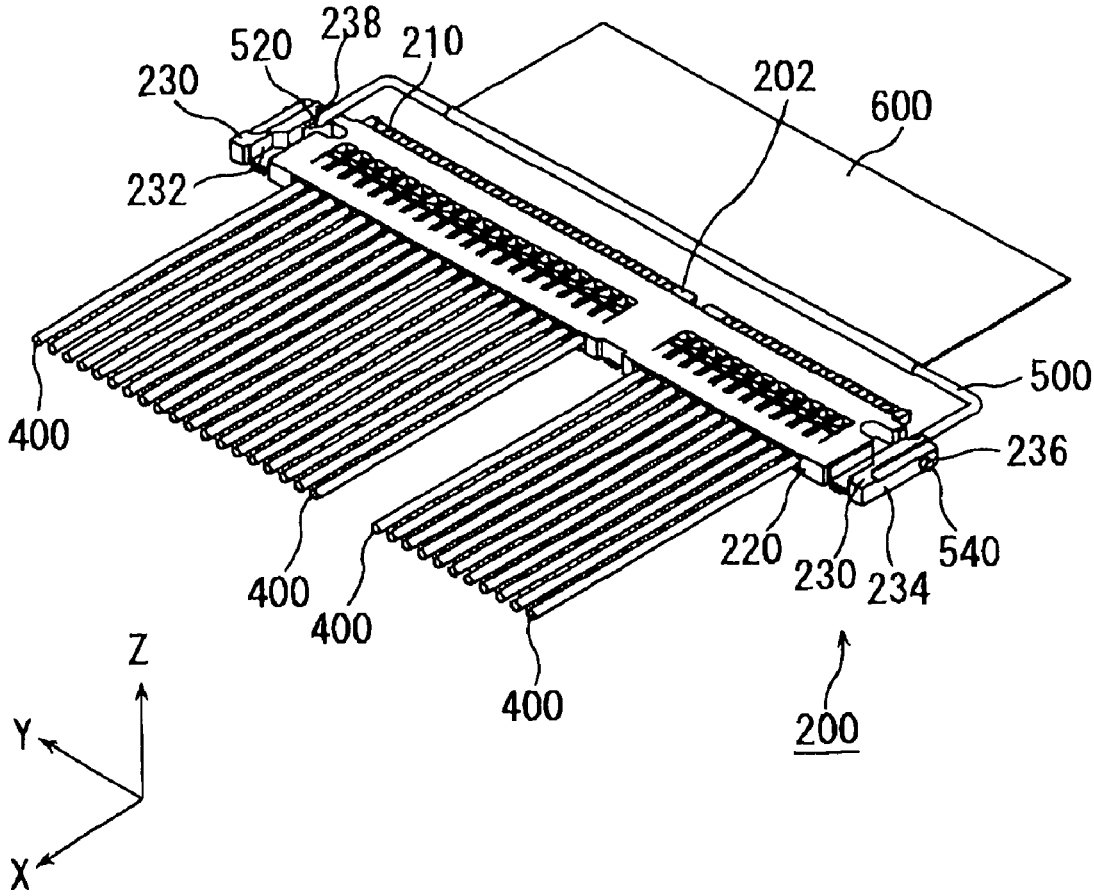
FIG. 2 is a perspective view showing the plug connector of FIG. 1.

As shown in FIG. 2, the plug connector 200 includes a plurality of contacts 210, a housing 220 having insulating properties, and side portions 230. The housing 220 is configured to hold the contacts 210. The contacts 210 are held by the housing 220 so that they can contact with the receptacle connector 300 at a mating portion 202 of the plug connector 200. A plurality of cables 400 are attached to a rear end of the housing 220. Signal lines of the cables 400 are connected to the contacts 210 within the housing 220. The housing 220 extends along the Y-direction (second direction). The side portions 230 are provided on opposite sides of the housing 220 in a longitudinal direction of the housing 220.

Figure 3:
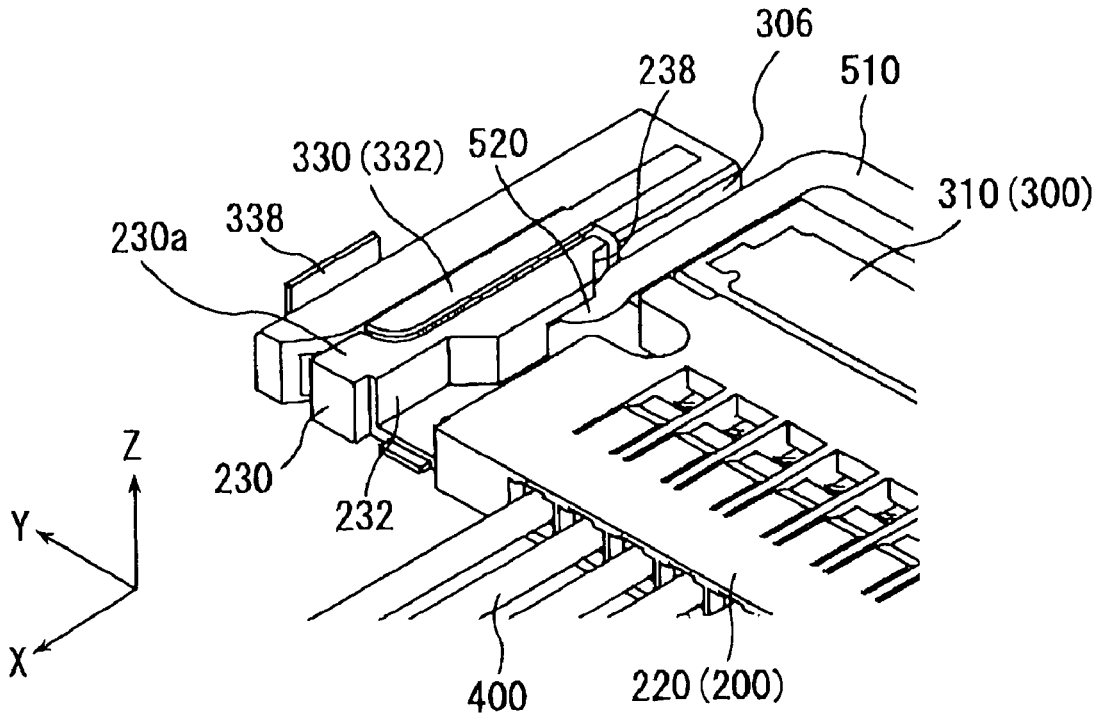
FIG. 3 is a partial perspective view enlarging an end of the connector assembly shown in FIG. 1.

As shown in FIGS. 2 and 3, each of the side portions 230 has a holding hole 236 extending through the side portion 230 from an inner surface 232 to an outer surface 234 along the Y-direction. Furthermore, each of the side portions 230 has a cam portion 238 formed on the inner surface 232. The holding holes 236 hold a lock operation member 500, which is produced by bending a metal rod.

Figure 4:
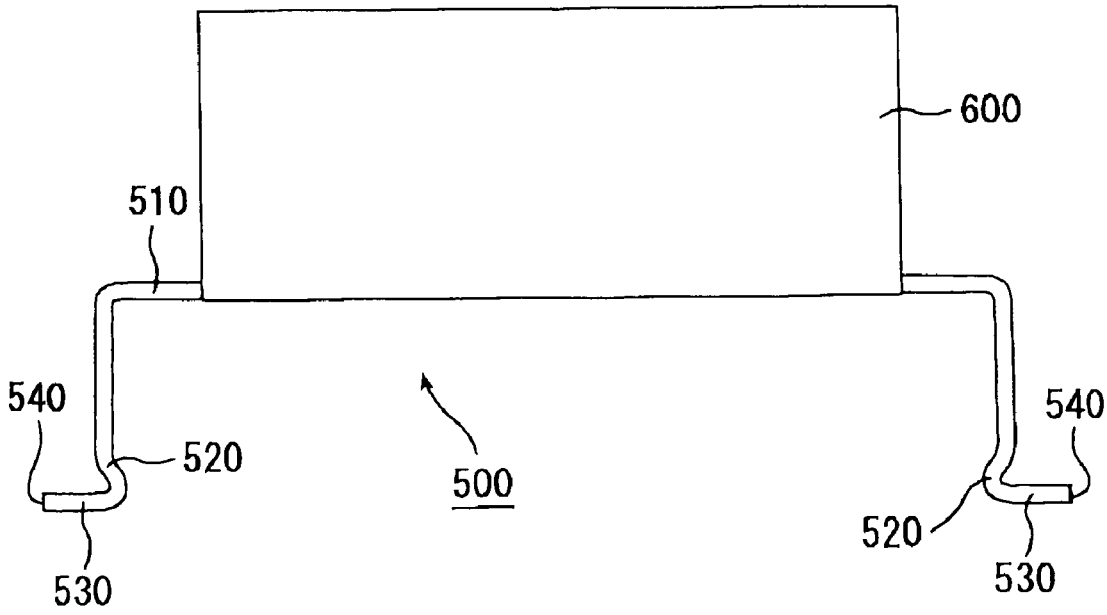
FIG. 4 is a plan view showing a lock operation member held by the plug connector of FIG. 2.

As shown in FIG. 4, the lock operation member 500 includes a hook-shaped base portion 510 to which an operation part 600 made of, for example, cloth is attached, cam followers 520 formed on opposite ends of the base portion 510, and retention portions 530 extending outward from the cam followers 520. The lock operation member 500 has ends that serve as lock portions 540 as described later. The length of the base portion 510 in the X-direction is determined in consideration of the distance between the inner surfaces 232 of the side portions 230. As a result, the cam followers 520 are pressed against the cam portions 238 of the side portions 230 according to operation of the operation part 600 (base portion 510), so that they follow the cam portions 238. Furthermore, the lock portions 540 projects outward in the Y-direction from the outer surfaces 234 of the side portions 230 in a state in which the operation part 600 (base portion 510) is not operated. Specifically, the lock portions 540 are biased by the base portion 510 so as to project outward in the Y-direction from the outer surfaces 234 of the side portions 230. The retention portions 530 are held in the holding holes 236 so as to be rotatable within the holding holes 236 formed in the side portions 230 and movable along the Y-direction according to movement of the Cam followers 520 on the cam portions 238.

Figure 5:
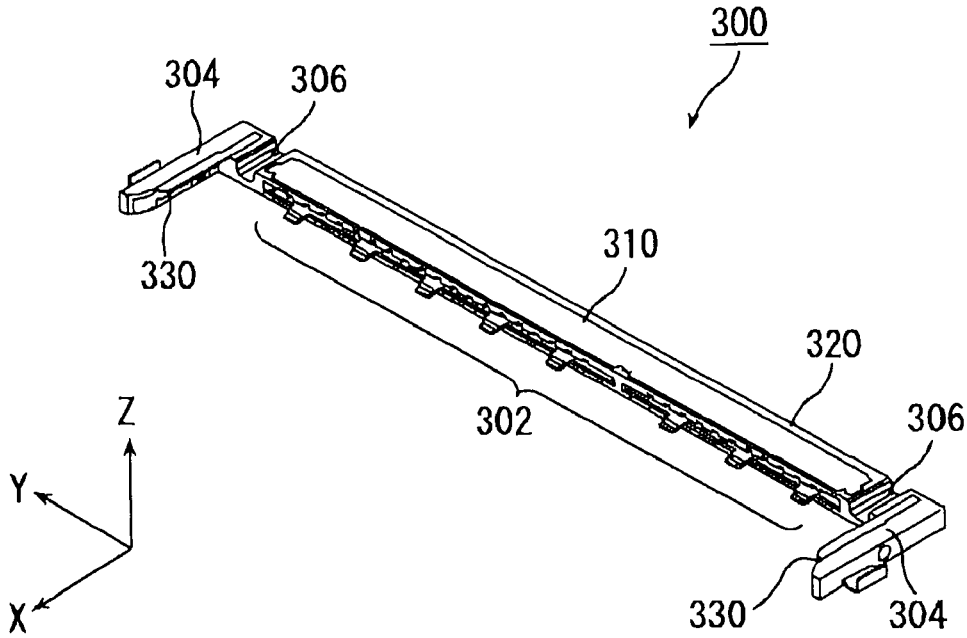
FIG. 5 is a perspective view showing the receptacle connector of FIG. 1.

As shown in FIG. 5, the receptacle connector 300 includes a body 302 configured to receive the mating portion 202 of the plug connector 200 along the X-direction and two arms 304 extending along the X-direction. The body 302 and the arms 304 form a hook-shape as viewed along the Z-direction. Specifically, the body 302 extends along the Y-direction and has grooves 306 formed on both sides of the body 302. The grooves 306 are recessed in the Z-direction. The grooves 306 extend along the X-direction. Each of the arms 304 is provided so as to interpose the groove 306 between the arm 304 and the body 302 in the Y-direction. The grooves 306 are used to receive part of the lock operation member 500, which will be described later.

Figure 6:
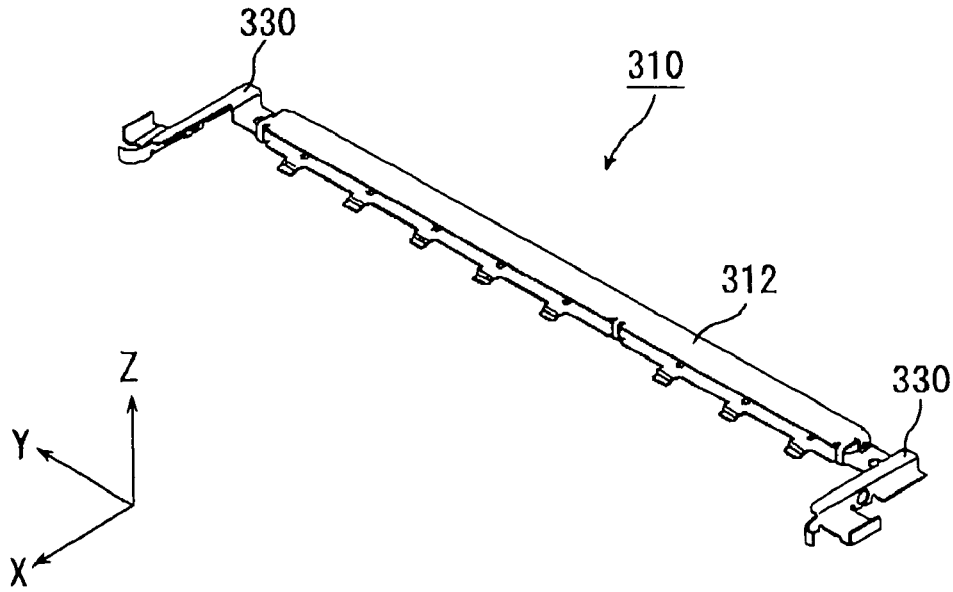
FIG. 6 is a perspective view showing a shell included in the receptacle connector of FIG. 5.

Specifically, the receptacle connector 300 according to the present embodiment includes a shell 310 made of metal, a housing 320 having insulating properties, and guide portions 330 made of metal. As shown in FIG. 6, the shell 310 of the present embodiment is formed by an integral structure of a shell base 312, which constitutes the body 302, and the guide portions 330. The shell 310 is incorporated into the housing 320 by a mold-in-place method when the housing 320 is formed. However, the present invention is not limited to this example. For example, the shell base 312 and the guide portions 330 may be formed separately from each other.

As can be seen from FIGS. 2 and 3, the guide portions 330 according to the present embodiment guide upper surfaces 230*a* and outer surfaces 234 of the side portions 230. As shown in FIG. 5, the guide portions 330 are provided on the arms 304, which extend along the X-direction longer than the body 302. Therefore, the guide portions 330 can be made long in the X-direction.

Figure 7:
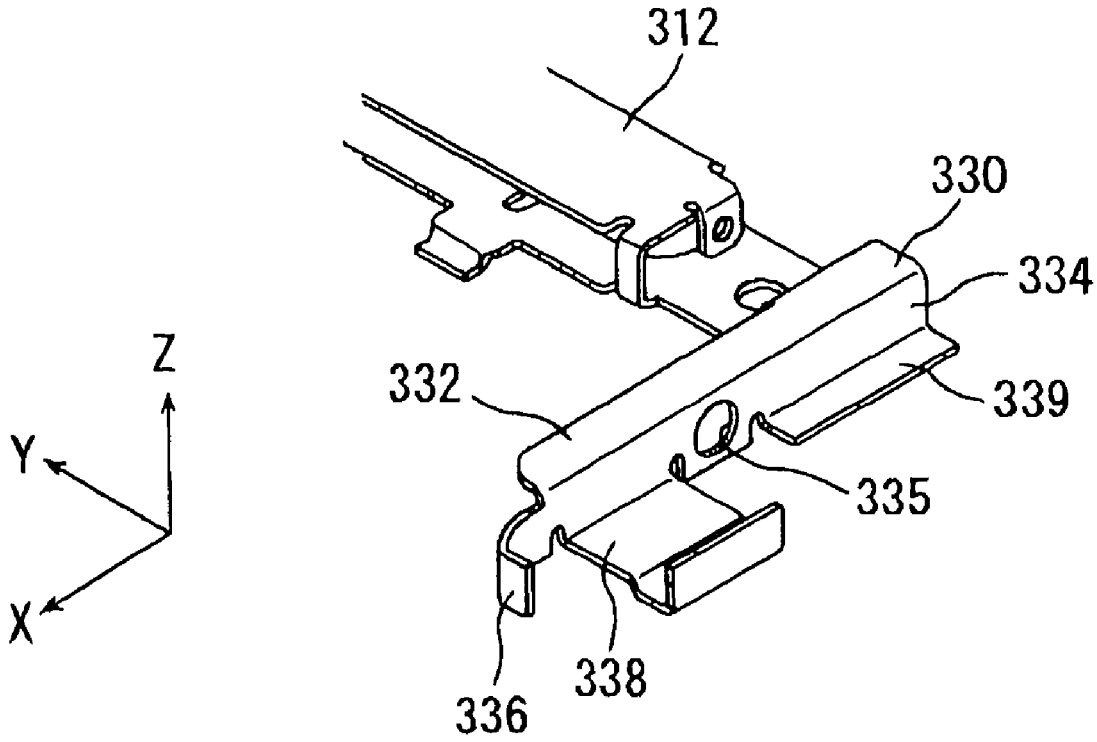
FIG. 7 is a partial perspective view enlarging an end of the shell shown in FIG. 6.

Specifically, as shown in FIG. 7, each of the guide portions 330 includes an upper wall 332 extending parallel to the XY-plane and a side wall 334 extending downward from the upper wall 332 and parallel to the XZ-plane. The side wall 334 has a lock hole 335 in which the corresponding lock portion 540 is engaged when the plug connector 200 is mated with the receptacle connector 300. In the present embodiment, each of the arms 304 as part of the housing 320 also has a hole corresponding to the lock hole 335 (see FIGS. 1 and 5). Thus, the lock portions 540 can be received in those holes of the arms 304 even if the lock portions 540 pass through the lock holes 335 and project more outward than the side walls 334.

As shown in FIG. 7, a leading portion 336 is provided on a front end of each side wall 334. The leading portions 336 are bent so as to spread outward in the Y-direction. The leading portions 336 serve to guide the side portions 230 of the plug connector 200 toward the guide portions 330 when the plug connector 200 is mated with the receptacle connector 300. A fixing portion 338 is provided near the front end of each side wall 334. The fixing portions 338 are connected and fixed to a substrate (not shown) on which the receptacle connector 300 is mounted by solder or the like. Furthermore, a mount portion 339 is formed near a rear end of each side wall 334. The mount portions 339 are mounted on the substrate. Thus, the guide portions 330 according to the present embodiment are formed integrally with the fixing portions 338 to be fixed to a substrate. Therefore, the guide portions 330 have some strength against upward forces.

In the connector assembly 100 thus constructed, the mating portion 202 of the plug connector 200 is inserted into the body 302 of the receptacle connector 300 along the X-direction (toward the negative X-direction), so that the plug connector 200 is mated with the receptacle connector 300. At that time, the lock operation member 500 is laid down so as to be parallel to the XY-plane as shown in FIG. 1. When the plug connector 200 is to be separated from the receptacle connector 300, the operation part 600 is pulled in the Z-direction to raise the lock operation member 500. By this operation, the cam followers 520 of the lock operation member 500 follow the cam portions 238 of the side portions 230. Hence, the lock portions 540 move toward inner sides of the side portions 230 along the Y-direction. Thus, the lock portions 540 are disengaged from the lock holes 335. When the lock operation member 500 is further laid down toward the rear side of the plug connector 200 with pulling the operation part 600, the plug connector 200 can be separated from the receptacle connector 300.

According to this connector assembly 100, the side portions 230 of the plug connector 200 are guided by the guide portions 330, which are formed integrally with the fixing portions 338 and extend relatively long in the X-direction. Therefore, the upper walls 332 of the guide portions 330 can prevent the side portions 230 from moving upward even if the cables 400, which are attached to the rear ends of the plug connector 200, are urged in a state in which the plug connector 200 is mated with the receptacle connector 300. Accordingly, the plug connector 200 is prevented from being detached unintentionally from the receptacle connector 300.

Additionally, unlike the connector assembly disclosed in JP-A 2005-267977, the mating state of the plug connector 200 with the receptacle connector 300 is locked by a lock mechanism including the lock portions 540 at the ends of the lock operation member 500, which is formed of a metal rod, and the lock holes 335 formed in the guide portions 330 in the connector assembly 100 according to the present embodiment. Therefore, no parts are required on the rear side of the plug connector 200 for the lock mechanism. Accordingly, an increase in size of the plug connector 200 along the X-direction can be prevented even if the length of the guide portions 330 is increased in the X-direction.

Furthermore, in the present embodiment, the grooves 306 are formed in the receptacle connector 300 to receive part of the base portion 510 of the lock operation member 500. Therefore, the lock operation member 500 can be laid down until it becomes parallel to the XY-plane in a state in which the plug connector 200 is mated with the receptacle connector 300. Accordingly, the thickness of the connector assembly 100 can be reduced.

As described above, according to the present invention, metal guide portions are formed on a receptacle connector integrally with fixing portions to be fixed to a substrate. The guide portions of the receptacle connector are configured to guide side portions of a plug connector. With this configuration, the connector assembly can have a structure that is strong against urging of cables or the like. Since each of the guide portions has an upper wall in particular, the connector assembly is less susceptible to vertical movement of the cables.

If the lock mechanism disclosed in Prior Art 1 is used, the side portions cannot be increased in size without an increase of the size of the plug connector. The present invention employs a mechanism closer to the lock mechanism of Prior Art 2 or Prior Art 3 than the lock mechanism of Prior Art 1. Accordingly, the side portions can be increased in size without an increase of the size of the plug connector.

Additionally, part of the lock mechanism (lock holes) and the guide portions are integrally formed in the receptacle connector. Therefore, the capability of maintaining the mating state can be enhanced without increasing the number of parts or unnecessarily increasing the size of the receptacle connector.

The present application is based on a Japanese patent application of JP2009-012408 filed before the Japan Patent Office on Jan. 22, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising:

a receptacle connector mounted on a substrate; and a plug connector matable with and removable from the receptacle connector on a plane parallel to the substrate, the plug connector including side portions, the receptacle connector including:

guiding portions configured to guide the side portions of the plug connector for mating and removal of the plug connector, and fixing portions fixed on the substrate and formed integrally with the corresponding guiding portions;

wherein each of the guiding portions includes:

an upper wall parallel to the substrate in a state in which the receptacle connector is mounted on the substrate, and a side wall extending downward from the upper wall;

wherein the plug connector includes a mating portion, and wherein the receptacle connector includes:

a body configured to receive the mating portion of the plug connector along a first direction, the body extending along a second direction perpendicular to the first direction, and two arms extending along the first direction from the body so that the body and the two arms form a hook-shape, the guiding portions being attached to the arms.

2. The connector assembly as recited in claim 1, wherein each of the guiding portions further includes:

a leading portion provided on a front end of the side wall for guiding the side portion when the plug connector is mated with the receptacle connector.

3. The connector assembly as recited in claim 1, wherein the receptacle connector includes a shell made of metal, and the guiding portions are formed integrally with the shell.

4. The connector assembly as recited in claim 1, further comprising a lock operation member having lock portions, the lock operation member being held by the side portions of the plug connector so that the lock portions move according to operation of the lock operation member, each of the guiding portions having a lock hole in which the corresponding lock portion can be inserted.

5. The connector assembly as recited in claim 4, wherein each of the side portions has an upper surface, an inner surface and an outer surface in the second direction, a holding hole extending through the side portion from the inner surface to the outer surface along the second direction, and a cam portion formed on the inner surface, the lock operation member includes a base, cam followers pushed against the cam portions according to operation of the base, and retention portions extending from the cam followers, each of the retention portions has an end that serves as the lock portion, the retention portions are held by the side portions so that the retention portions are movable along the second direction according to movement of the cam followers on the cam portions and are rotatable within the holding hole, the lock portions are biased by the base so as to project from the outer surfaces of the side portions, the guiding portions are configured to guide the upper surfaces and the outer surfaces of the side portions, and the lock holes are formed in the side walls of the guiding portions so as to receive the lock portions when the plug connector is mated with the receptacle connector.

6. A plug connector matable with and removable from a receptacle connector on a plane parallel to a substrate on which the receptacle connector is mounted, the plug connector comprising:

side portions guided by guiding portions of the receptacle connector for mating and removal of the plug connector, the guiding portions being formed integrally with fixing portions of the receptacle connector fixed on the substrate;

wherein each of the guiding portions includes:

an upper wall parallel to the substrate in a state in which the receptacle connector is mounted on the substrate, and a side wall extending downward from the upper wall;

wherein the plug connector includes a mating portion, and wherein the receptacle connector includes:

a body configured to receive the mating portion of the plug connector along a first direction, the body extending along a second direction perpendicular to the first direction, and two arms extending along the first direction from the body so that the body and the two arms form a hook-shape, the guiding portions being attached to the arms.

7. A receptacle connector mounted on a substrate, the receptacle connector comprising:

guiding portions configured to guide side portions of a plug connector for mating and removal of the plug connector, the plug connector being matable with and removable from the receptacle connector on a plane parallel to the substrate; and fixing portions fixed on the substrate and formed integrally with the corresponding guiding portions;

wherein each of the guiding portions includes:

an upper wall parallel to the substrate in a state in which the receptacle connector is mounted on the substrate, and a side wall extending downward from the upper wall;

wherein the plug connector includes a mating portion, and wherein the receptacle connector includes:

a body configured to receive the mating portion of the plug connector along a first direction, the body extending along a second direction perpendicular to the first direction, and two arms extending along the first direction from the body so that the body and the two arms form a hook-shape the guiding portions being attached to the arms.

* * * * *